United States Patent [19]

Shibata et al.

[11] Patent Number: 4,637,200

[45] Date of Patent: Jan. 20, 1987

[54] CONTAINER FORMING APPARATUS FOR PACKAGING MACHINE

[75] Inventors: Masato Shibata, Tokushima; Mamoru Eguchi; Yoshihito Kondo, both of Naruto, all of Japan

[73] Assignee: Shikoku Kakooki Co., Ltd., Tokushima, Japan

[21] Appl. No.: 661,989

[22] Filed: Oct. 18, 1984

[30] Foreign Application Priority Data

Oct. 18, 1983 [JP] Japan ..... 58-195101

[51] Int. Cl.[4] ..... B65B 9/06

[52] U.S. Cl. ..... 53/551; 53/554; 74/89.15

[58] Field of Search ..... 53/551, 554, 552; 74/89.15; 310/15, 17, 21, 37

[56] References Cited

U.S. PATENT DOCUMENTS

| | | | |
|---|---|---|---|
| 3,055,154 | 9/1962 | Markley et al. | 53/551 |
| 3,451,187 | 6/1969 | Massey et al. | 53/554 |
| 3,546,930 | 12/1970 | Flarsheim | 74/89.15 |
| 3,640,138 | 2/1972 | Hahn et al. | 74/89.15 |
| 4,444,540 | 4/1984 | Blatt et al. | 74/89.15 |
| 4,466,769 | 8/1984 | Inaba et al. | 74/89.15 |
| 4,483,126 | 11/1984 | Henry | 53/551 |

*Primary Examiner*—John Sipos
*Assistant Examiner*—Donald R. Studebaker
*Attorney, Agent, or Firm*—Armstrong, Nikaido, Marmelstein & Kubovcik

[57] ABSTRACT

A container forming apparatus for packaging machine by which a vertical tube filled with contents is sealed over a required width at a spacing corresponding to the length of one container and is cut at the midportion of the seal width, the apparatus comprising a slide having forming jaws, and a slide lift assembly drivingly movable by a pulse motor.

4 Claims, 3 Drawing Figures

CONTAINER FORMING APPARATUS FOR PACKAGING MACHINE

The present invention relates to a container forming apparatus for a packaging machine which is adapted to form a tube from a web serving as a packaging material, to fill fluid food or the like into the tube and to eventually form the filled tube into a finished container in the form of a box, the apparatus being so adapted that the tube filled with the contents and disposed in a vertical position is sealed over a required width at a spacing corresponding to the length of one container and is cut at the midportion of the seal width.

Some packaging machines are designed to form containers of different heights to give varying capacities to the containers.

Apparatus of the type described are known in which a vertical tube filled with contents is sealed by being strongly pressed on its opposite sides by jaws which are moved upward and downward at a given stroke in timed relation to the opening and closing of the jaws. The stroke length, which corresponds to one container, needs to be altered when the capacity of the container is to be varied.

The main object of the present invention is to provide a container forming apparatus for a packaging machine wherein the stroke length of the jaws is variable easily and reliably.

The present invention provides a container forming apparatus comprising a slide having forming jaws, and a slide lift assembly which is driven by a pulse motor. The stroke length of the slide, i.e. the vertical stroke length of the jaws, is variable as desired by suitably setting the amount of rotation of the pulse motor.

For illustrative purposes only, an embodiment of the invention will be described below with reference to the accompanying drawings.

Figure 1:
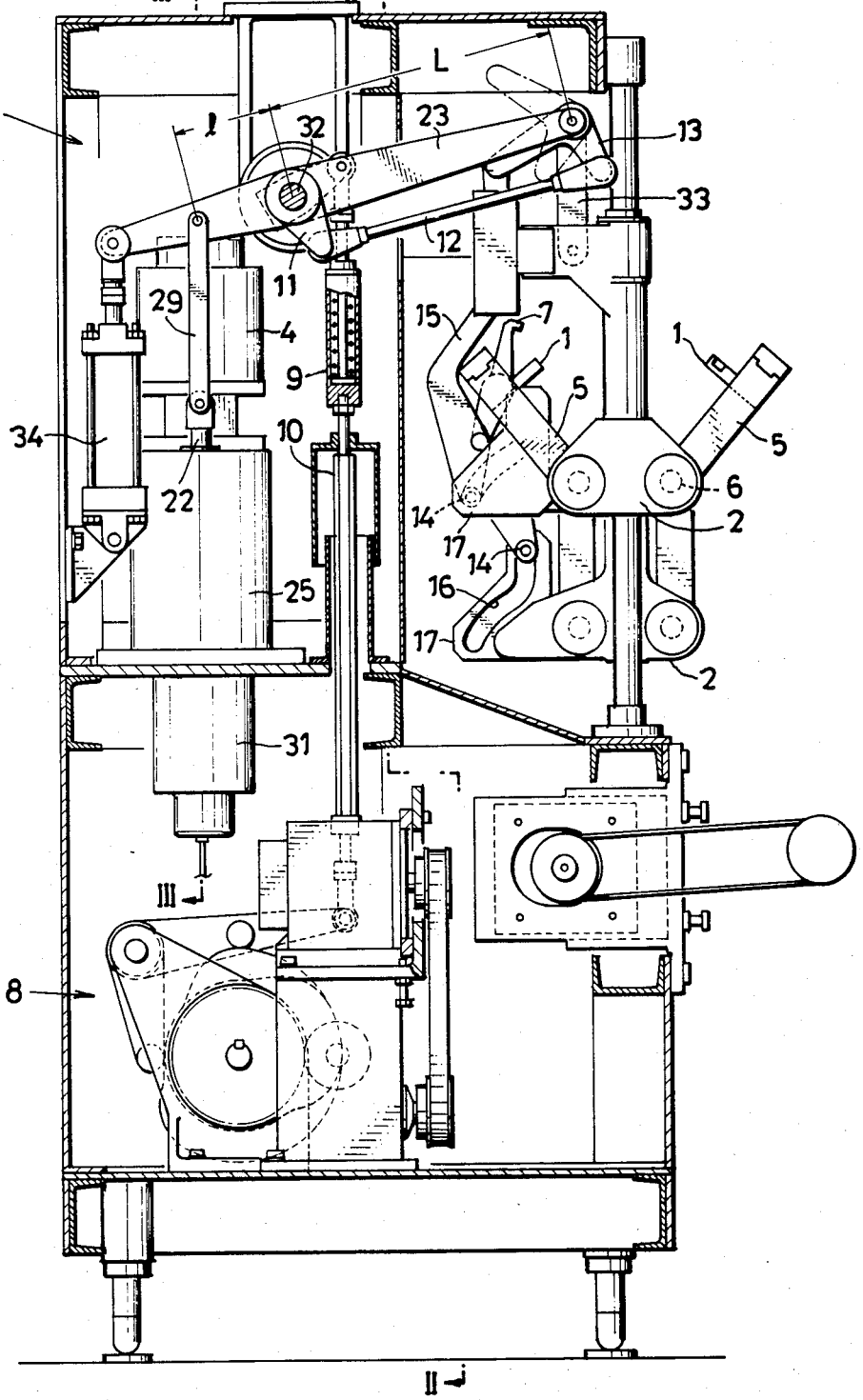
FIG. 1 is a side elevation partly in section and showing a container forming apparatus of the invention.
Figure 2:
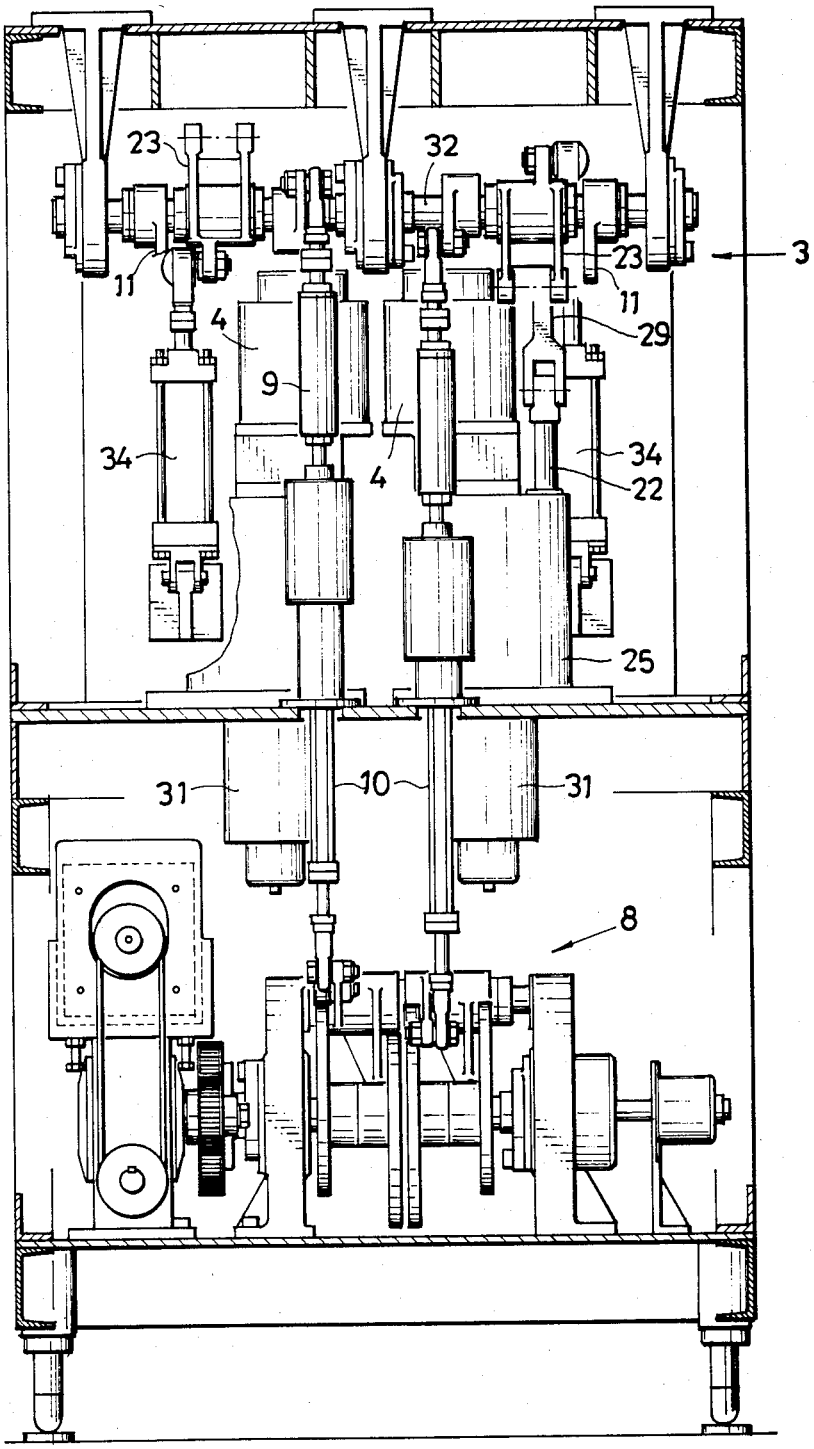
FIG. 2 is a view in section taken along the line II—II in FIG. 1.

Although not shown in detail, the container forming apparatus of the invention is composed of a left half portion and a right half portion which have the same construction but which are oriented in different directions. Each portion comprises a slide 2 having forming jaws 1, and a slide lift assembly 3 which is driven by a pulse motor 4.

The forming jaws 1 are fixed to a pair of pivotal arms 5, each at an upper portion of each arm, and are opposed to each other. Although not shown, one of the jaws 1 has a heater embedded therein for heat sealing, and the other jaw a cutter. The two pivotal arms 5 are supported at their lower portions by the slide 2 so that the jaws 1 are pivotally movable about horizontal parallel rods 6 toward each other to a closed position and away from each other to an open position. A pair of engageable pawls 7 are provided at opposite sides of the jaws 1 on the pivotal arms 5. When the pawls 7 are drawn toward each other, with the arms 5 closed to position the jaws 1 close to each other, the jaws 1 are drawn toward each other to produce a sealing pressure therebetween. The mechanism for opening and closing the two arms 5, and the mechanism for drawing the pawls 7 toward each other are already known, for example, as disclosed in Published Examined Japanese Utility Model Application No. 43427/1977. The mechanism shown comprises a cam assembly 8, a lift rod 10 having a damper 9 and movable by the cam assembly 8, a first arm 11, connected to the upper end of the lift rod 10, a second arm 13 connected to the first arm 11 by a rod 12, a three-point link 15 connected to the second arm 13 and having a roller 14, and a cam 17 fixed to the slide 2 and having a guide groove 16 for the roller 14.

The two slides 2 are vertically moved alternately in different directions at a specified stroke in timed relation with each other. More specifically, when one of the slides 2 rises, the other slide 2 lowers. When the slide 2 is at the upper limit position of its stroke, the jaws 1 are closed, whereby a tube is sealed over a predetermined width by being clamped with a high pressure transversely thereof. The tube is sent forward by a length corresponding to one container by the jaws 1 moving downward with the slide 2, with the tube clamped therebetween. When the slide 2 reaches its lower limit position, the cutter functions, cutting the tube at the midportion of the seal width, whereupon the jaws are opened to release the tube. Consequently the forward end portion of the tube corresponding to one container is separated from the remaining tube portion.

Figure 3:
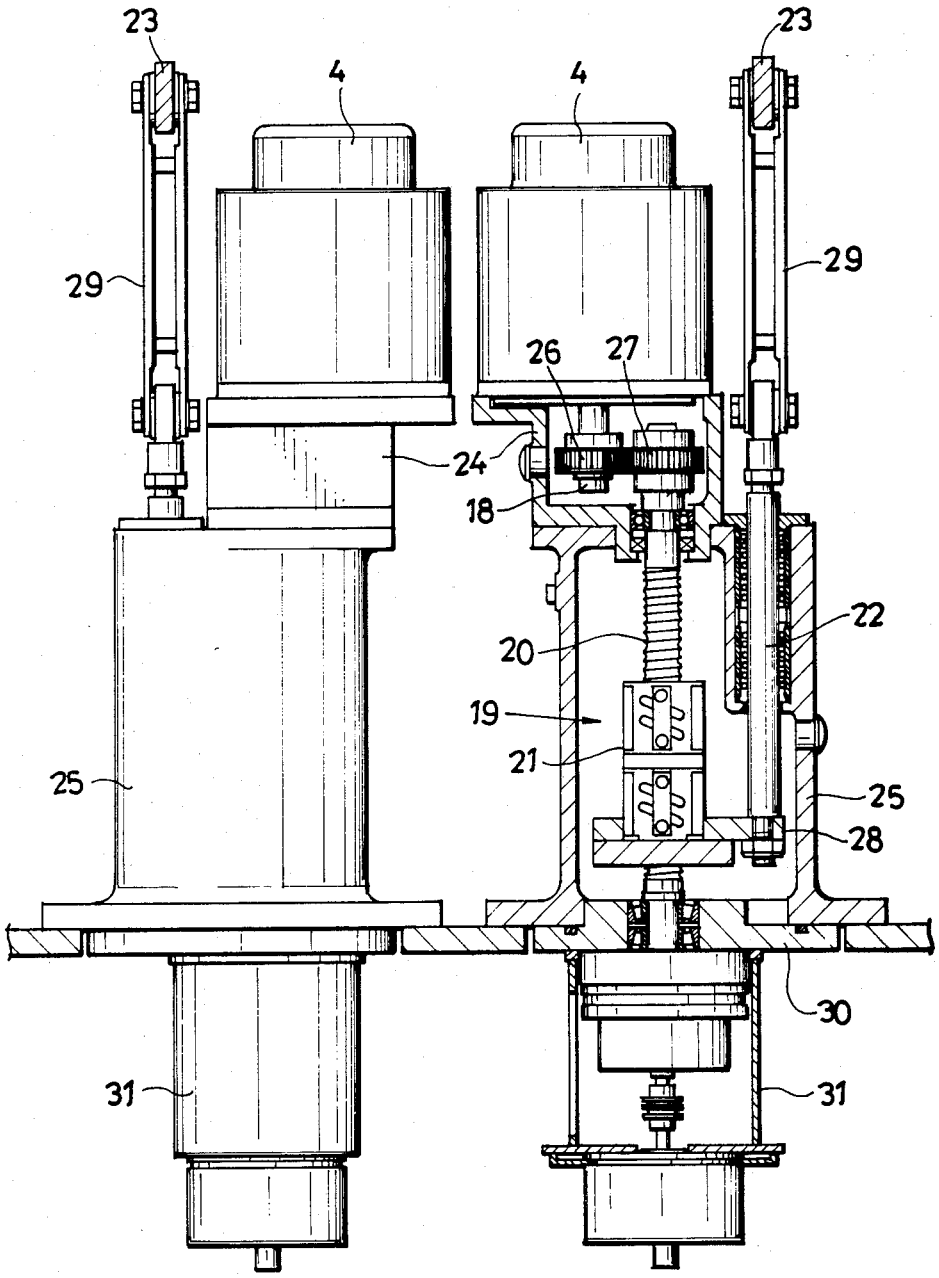
FIG. 3 is an enlarged view in section taken along the line III—III in FIG. 1.

As shown in detail in FIG. 3, the slide lift assembly 3 comprises a vertical screw rod 20 included in ball screw means 19 and coupled to the output shaft 18 of the pulse motor 4, a vertical slide rod 22 connected to a nut 21 of the ball screw means 19, and a pivotal arm 23 having the slide 2 and the vertical slide rod 22 connected thereto at opposite sides of its supported point.

The pulse motor 4 is mounted on the upper end of an upper case 24 in the form of a vertical bottomed hollow cylinder to close the opening thereof. The output shaft 18 of the pulse motor 4 extends into the upper case 24. The screw rod 20 is housed in a lower case 25 in the form of an inverted vertical bottomed hollow cylinder and positioned beneath the upper case 24. The screw rod 20 projects into the upper case 24 through the bottom wall of the lower case 25 and through the bottom wall of the upper case 24. Gears 26, 27 meshing with each other are fixed to the projecting end of the screw rod 20 and to the output shaft 18, respectively. The nut 21 is accommodated in the lower case 25 along with the screw rod 20. A connecting plate 28 attached to the lower end of the nut 21 is attached to the lower end of the slide rod 22, whereby the nut 21 is connected to the slide rod 22. The vertical slide rod 22 has a lower portion accommodated in the lower case 25 and an upper portion projecting from the lower case 25 and extending upward at one side of the upper case 24. A connecting rod 29 has an upper end connected to the pivotal arm 23 and a lower end connected to the upper end of the slide rod 22. A closure 30 is attached to the open lower end of the lower case 25. An electromagnetic brake 31 is attached to the under surface of the closure 30. The screw rod 20 has a lower end extending through the closure 30 and connected to the brake 31. The pivotal arm 23 is supported by a horizontal rotary shaft 32 extending sidewise in the rear of the slide 2. The front end of the pivotal arm 23 is connected to the slide 2 by a rod 33.

With reference to FIG. 1, the distance L from the supported point of the pivotal arm 23 to the slide connected portion thereof is larger than the distance l from the supported point to the slide rod connected portion thereof. A balance cylinder 34 is connected to one end of the pivotal arm 23 opposite to the slide connected portion. The biasing force of the balance cylinder 34 is of course so determined as to be in balance with the weight of the reciprocating assembly including the slide 2. The arrangement described makes it possible to amplify the work amount of the pulse motor 4 before it is transmitted to the slide 2 and also to move the slide at a very high speed by a motor of small capacity.

When the pulse motor 4 is operated to rotate the output shaft 18, the screw rod 20 of the ball screw means 19 coupled thereto rotates in the same direction. Consequently the nut 21 of the ball screw means 19 and the slide rod 22 connected thereto rise or lower, pivotally moving the arm 23 to lower or raise the slide 2. The stroke length of the slide 2 is in proportion to the amount of rotation of the pulse motor 4, so that the stroke length is adjustable by suitably determining the amount of rotation of the pulse motor 4. The stroke length corresponds to the length of one container.

What is claimed is:

1. A container forming apparatus for a packaging machine by which a vertical tube filled with contents is sealed over a required width at a spacing corresponding to the length of one container and is cut at the midportion of the seal width, the apparatus comprising:

an apparatus frame provided with a vertical guide rod, a horizontal pin disposed laterally of the vertical guide rod, and a horizontal rotary axis arranged between the vertical guide rod and the horizontal pin in the horizontal direction and disposed above and parallel to the horizontal pin in the vertical direction;

a slide having forming jaws and movable upward and downward along the vertical guide rod;

a balance cylinder pivotally supported by the horizontal pin at its lower portion and provided with a piston rod possessing a force proportional to the weight of the slide with reciprocally movable parts mounted thereon;

a pivotal arm suspending the slide through a connecting rod at its one end and connected to the piston rod of the balance cylinder at its other end, the pivotal arm being supported at a point between its opposite ends by the horizontal rotary shaft; and, a means mounted on the apparatus frame, for turning the pivotal arm so as to lift the frame.

2. An apparatus as defined in claim 1, wherein the means for turning the pivotal arm includes a pulse motor operable not only to turn the pivotal arm and vary its amplitude but also to lift the slide and change its stroke length.

3. An apparatus as defined in claim 2, wherein the pulse motor is disposed below the pivotal arm and provided with an output shaft extending vertically downwardly, the means for turning the pivotal arm including a vertical screw rod included in ball screw means and coupled to the output shaft of the pulse motor, and a vertical slide rod connected to a nut of the ball screw means and having an upper end connected to a point between the supported point of the pivotal arm and the point at which the balance cylinder connects with the pivotal arm through the connecting rod.

4. An apparatus as defined in claim 3, wherein the pulse motor is mounted on the upper end of an upper case in the form of a vertical bottomed hollow cylinder to close the opening thereof, the output shaft of the pulse motor extending into the upper case, the screw rod being housed in a lower case in the form of an inverted vertical botomed hollow cylinder and positioned beneath the upper case, the screw rod having an upper portion projecting into the upper case through the bottom wall of the lower case and through the bottom wall of the upper case, gears meshing with each other and being fixed to the projecting end of the screw rod and to the output shaft individually, the vertical slide rod having a lower portion accommodated in the lower case and an upper portion projecting from the lower case and extending upward at one side of the upper case.

* * * * *